US005333688A

United States Patent [19]

Jones et al.

[11] Patent Number: 5,333,688

[45] Date of Patent: Aug. 2, 1994

[54] METHOD AND APPARATUS FOR GRAVEL PACKING OF WELLS

[75] Inventors: Lloyd G. Jones, Dallas; Tommy J. Yates, Coppell, both of Tex.

[73] Assignee: Mobil Oil Corporation, Fairfax, Va.

[21] Appl. No.: 1,605

[22] Filed: Jan. 7, 1993

[51] Int. Cl.[5] ..... E21B 43/04; E21B 43/08

[52] U.S. Cl. ..... 166/278; 166/51; 166/235

[58] Field of Search ..... 166/235, 236, 242, 243, 166/51, 278

[56] References Cited

U.S. PATENT DOCUMENTS

| | | | |
|---|---|---|---|
| 4,424,859 | 1/1984 | Sims et al. | 166/67 |
| 4,945,991 | 8/1990 | Jones | 166/278 |
| 4,995,456 | 2/1991 | Cornette et al. | 166/51 |
| 5,033,549 | 7/1991 | Champeaux et al. | 166/235 X |
| 5,082,052 | 1/1992 | Jones et al. | 166/51 |
| 5,113,935 | 5/1992 | Jones et al. | 166/51 |
| 5,161,613 | 11/1992 | Jones | 166/242 |
| 5,161,618 | 11/1992 | Jones et al. | 166/308 |

*Primary Examiner*—Terry Lee Melius

*Attorney, Agent, or Firm*—Alexander J. McKillop; George W. Hager, Jr.

[57] ABSTRACT

A method and apparatus for gravel packing wherein a gravel slurry is distributed to different points of a wellbore annulus from a internal passage within the apparatus thereby protecting the passage from damage during operation. The apparatus is comprised of a plurality of gravel screen units which are connected together at the lower end of a workstring. Each gravelscreen unit is comprised of a gravel screen and a valve-outlet assembly which, in turn, is comprised of a collar having an outlet and a valve for opening and closing the outlet. A washpipe is positioned within the workstring and provides a passage for delivering the slurry internally to the outlets in each of the valve-outlet assemblies. The valves are closed when the washpipe is removed.

11 Claims, 2 Drawing Sheets

METHOD AND APPARATUS FOR GRAVEL PACKING OF WELLS

1. TECHNICAL FIELD

The present invention relates to the gravel packing of wells and in one of its aspects relates to a method and apparatus for gravel packing a well wherein the gravel slurry is delivered into different points within the wellbore annulus from the interior of the apparatus through a plurality of spaced outlets along the apparatus which, in turn, are closed after the gravel has been placed.

2. BACKGROUND

In producing hydrocarbons or the like from loosely or unconsolidated and/or fractured subterranean formations, it is not uncommon to produce large volumes of particulate material (e.g. sand) along with the formation fluids. These particulates routinely cause a variety of problems which result in added expense and substantial downtime. For example, in most instants, particulates in the produced fluids cause (1) severe erosion of the well tubing and other production equipment; (2) partial or complete clogging of the flow from the well which requires workover of the well; (3) caving in the formation and collapse of the well casing; (4) extra processing of the fluids at the surface to remove the particulates; and (5) extra cost in disposing of the particulates once they have been separated. Accordingly, it is extremely important to control the production of particulates in most operations.

Probably the most popular technique used for controlling the production of particulates (e.g. sand) from a well is one which is known as "gravel packing". In a typical gravel pack completion, a screen is lowered into the wellbore and positioned adjacent the interval of the well which is to be completed. Particulate material, collectively referred to as gravel, is then pumped as a slurry down the tubing on which the screen is suspended. The slurry exits the tubing above the screen through a "cross-over" or the like and flows downward in the annulus formed between the screen and the well casing or open hole, as the case may be. The liquid in the slurry flows into the formation and/or the openings in the screen which are sized to prevent the gravel from flowing therethrough. This results in the gravel being deposited or "screened out" in the annulus around the screen where it collects to form the gravel pack. The gravel is sized so that it forms a permeable mass around the screen which allows flow of the produced fluids therethrough and into the screen while blocking the flow any particulates produced with the formation fluids.

One of the major problems associated with gravel packing, especially where long or inclined intervals are to be completed, is the proper distribution of the gravel over the entire interval to be completed, i.e. completely packing the annulus between the screen and the casing in cased wells or between the screen and the wellbore in open hole or under-reamed completions. Poor distribution of gravel (i.e. incomplete packing of the interval resulting in voids in the gravel pack) is often caused by the loss of liquid from the gravel slurry into the more permeable portions of the formation interval which, in turn, causes the formation of gravel (e.g. sand) "bridges" in the annulus before all of the gravel has been placed. These bridges block further flow of the slurry through the annulus thereby preventing the placement of sufficient gravel (a) below the bridge for top-to-bottom packing operations or (b) above the bridge, for bottom-to-top packing operations.

U.S. Pat. No. 4,945,991 discloses a method for gravel packing an interval of a wellbore wherein there is good distribution of the gravel throughout the desired interval even where sand bridges form before all the gravel is deposited. In this method, perforated shunts or conduits are provided along the external surface of the screen which are in fluid communication with the gravel slurry as it enters the annulus in the wellbore adjacent the screen. If a sand bridge forms before all of the gravel is placed, the slurry will flow through the conduits and out into the annulus through the perforations in the conduits to complete the filling of the annulus above and/or below the bridge. See also, U.S. Pat. No. 5,113,935 for a similar technique.

In some instances, valve-like devices have been provided for the perforations in these conduits so that there is no flow of slurry through the conduits until a bridge is actually formed in the annulus; see U.S. Pat. No. 5,082,052. In all of these prior art apparatuses used for gravel packing, the individual conduits or shunts are carried externally on the screen where they are exposed to damage, possibly severe, during the handling and placement of the screen.

Other downhole well tools have been proposed for fracturing a formation (U.S. Pat. No. 5,161,618) or treating a formation (U.S. Pat. No. 5,161,613) wherein individual conduits or shunts are positioned internally within a housing or the like to deliver a particular treating or fracturing fluid to selective levels within the wellbore. However, the outlets through the housing remain open after the particular operation is completed which would normally prove detrimental in a gravel packing operation.

SUMMARY OF THE INVENTION

The present invention provides a method and apparatus for gravel packing an interval of a wellbore wherein there is a good distribution of gravel over the entire interval even if a sand bridge or the like is formed within the interval before the placement of the gravel is completed. Basically, the present invention provides for distributing the gravel slurry to different points of the wellbore annulus from an internal passage within the apparatus where it is protected from damage during handling and installation. The outlets through which the gravel slurry is delivered to the wellbore annulus are then closed after the gravel has been placed.

More specifically, the gravel pack apparatus of the present invention is comprised of a plurality of gravel screen units which are connected together at the lower end of a workstring. The gravel pack apparatus is positioned adjacent the wellbore interval to be completed and forms an annulus with the wellbore. Each gravel-screen unit is comprised of a valve-outlet assembly and a gravel screen. Each valve-outlet assembly, in turn, is comprised of a collar having at least one radial outlet port and an internal recess. A sleeve value is slidably positioned within said recess and is movable between an open position and a closed position. The sleeve valve has a radial opening therethrough which aligns with said outlet in the collar when said valve is in an open position. Also, slidably mounted within the recess is a detent ring which provides a means for securing the valve in its closed position.

A washpipe is positioned within the workstring and extends from the surface through all of the screen units. The lower end of the washpipe (i.e. that portion which extends through the screen units) is comprised of two concentric tubulars members which form a passage therebetween. The upper end of the inner tubular member communicates with a cross-over which diverts upward flow in the inner member back to the surface while allowing flow from the washpipe into the passage between the two tubular members.

One or more radial ports are provided through the outer member of the washpipe at spaced lengths so that each port or set of radial ports will fluidly communicate with the radial opening of a respective sliding sleeve valve when the valve is in its open position.

In operation, the gravel pack apparatus is lowered into the wellbore on the workstring and is positioned adjacent the formation to be completed. A packer is set and gravel slurry is pumped down the washpipe. A portion of the slurry flows into the wellbore annulus through an outlet in a cross-over which is connected at the upper end of the gravel screen units while the remainder of the slurry flows through the passage between the inner and outer members of the washpipe and out into the wellbore at different points through the respective outlets in the valve-outlet assemblies.

When the desired interval of the wellbore annulus has been gravel packed, flow of slurry is stopped and the washpipe is removed to the surface. The detent ring will engage a shoulder on the washpipe as it moves upward and will move the sliding sleeve valve to a closed position. As valve 38 reaches its closed position, a detent on the ring will engage the collar to secure the valve in its closed position.

The distribution of gravel to different points in the annulus through an internal passage is believed to provide a better distribution of gravel throughout the completion interval and a better overall gravel pack efficiency, especially where long intervals are being completed. At the same time, the distribution passages, being internal of the apparatus, are well protected from damage and abuse during the handling and installation of the gravel pack screen.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
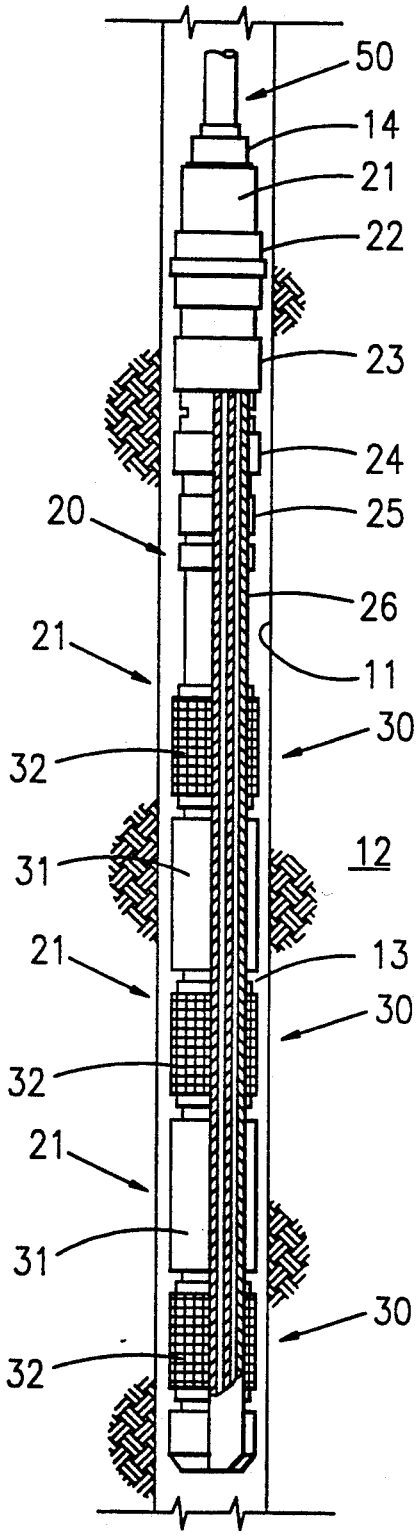
FIG. 1 is an elevational view, partly in section, of the gravel pack apparatus of the present invention in an operable position within a wellbore.

Referring more particularly to the drawings, FIG. 1 illustrates the lower end of a producing and/or injection well 10. Well I 0 has a wellbore 11 which extends from the surface (not shown) through an unconsolidated and/or fractured production and/or injection formation 12. While well 10 is illustrated as a substantially vertical, open-completed well, it should be recognized that the present invention is equally applicable for use in cased wells and/or underreamed completions as well as in horizontal and/or inclined wellbores.

Gravel pack apparatus 20 of the present invention is lowered into wellbore 11 on the bottom of workstring 14 and positioned adjacent the completion interval of formation 12 to form annulus 13 with wellbore 11. Apparatus 20 may be comprised of all or some of the following standard gravel packing components: setting tool and cross-over assembly 2 1, packer 22, cross-over extension 23, knock-out valve 24 , shear-out joint 25, and the desired length of standard, blank pipe 26. Connected to the lower end of the blank pipe 26 are one or more gravel-screen units 30 (three shown) which are connected together to extend substantially through the completion interval of the formation. Since each of screen units 30 have the same basic construction, only one will be described in detail.

Figure 2:
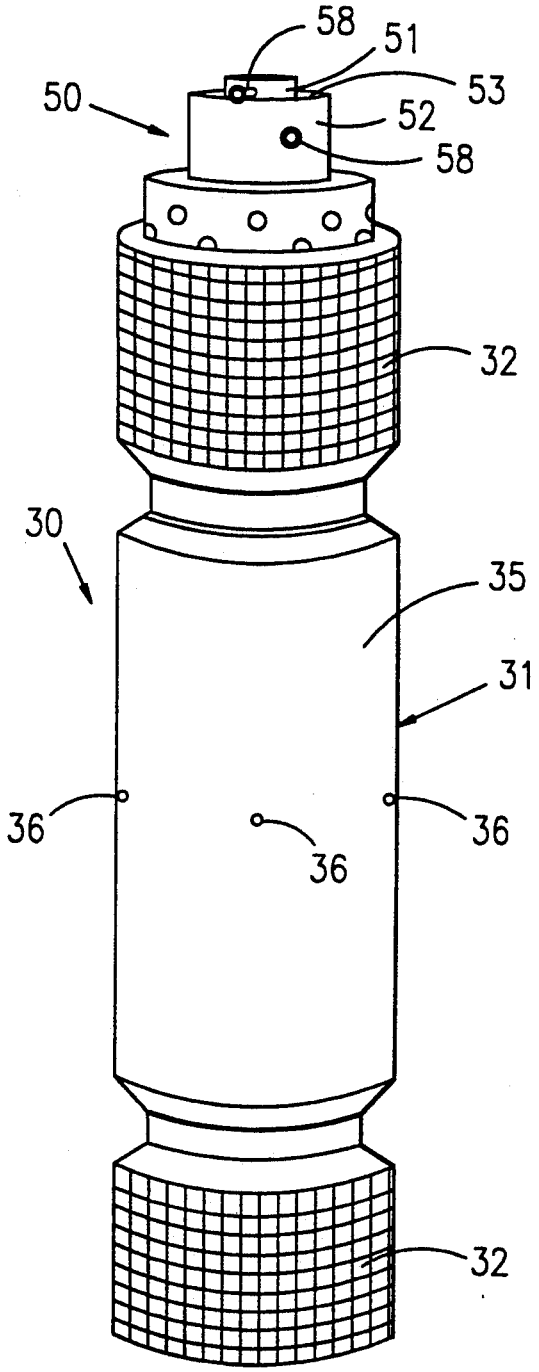
FIG. 2 is an enlarged perspective view, partly cut away, of one of the gravel screen units which forms a part of the apparatus of FIG. 1.
Figure 3:
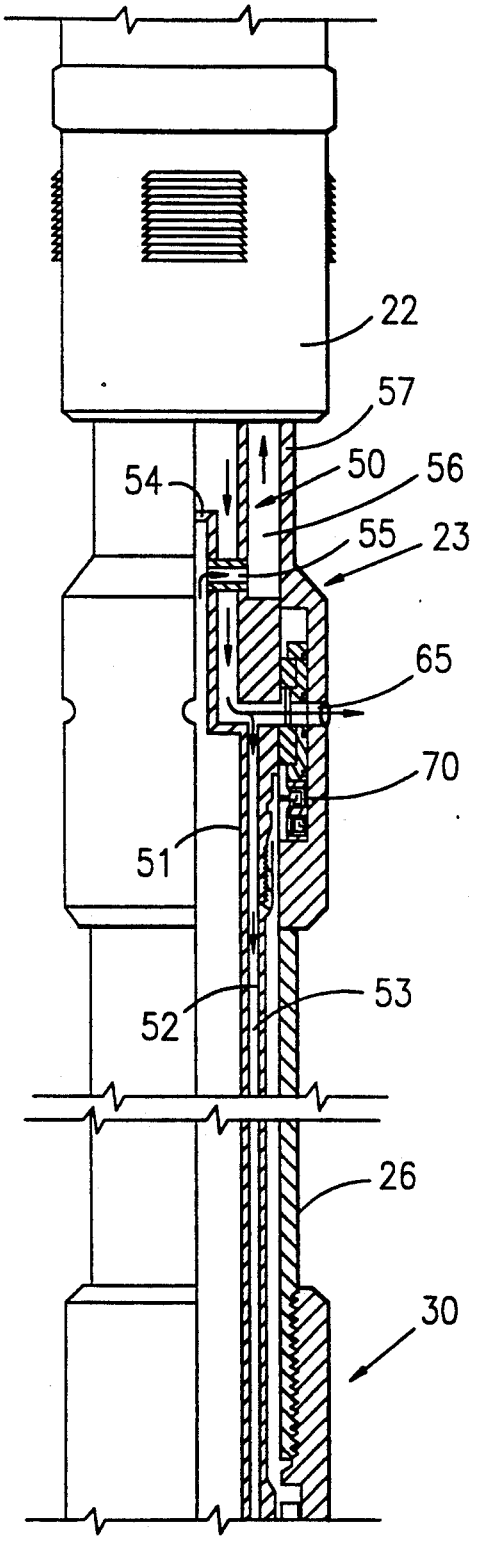
FIG. 3 is an elevational view, partly in section, of the cross-over extension and the upper portion of the wash pipe of the gravel pack apparatus of FIG. 1.

Referring now to FIGS. 2–4, each gravel-screen unit 30 is comprised of a sliding sleeve valve-outlet assembly 31 and a screen section 32. The term "screen" is used generically herein and is meant to include and cover all types of those structures commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof).

Figure 4A:
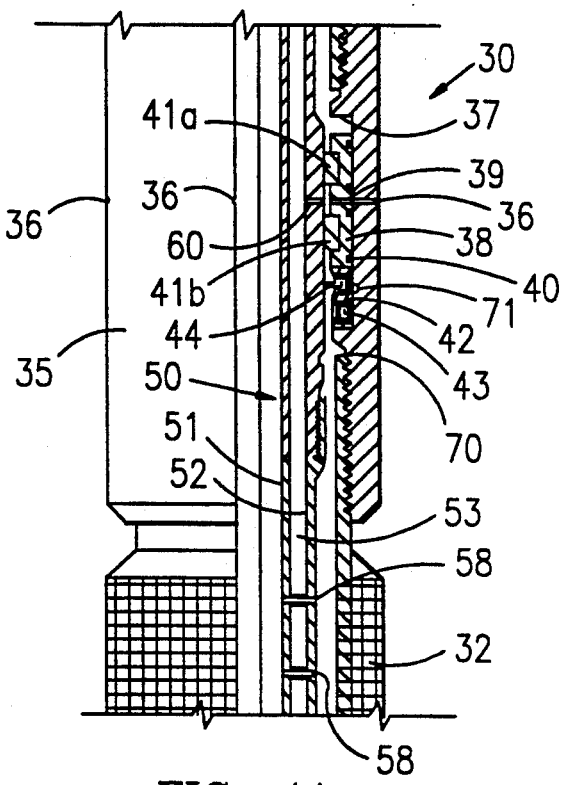
FIG. 4A is an elevational view, partly in section, of a portion of the sliding valve-outlet assembly of FIG. 2 with the valve in an open position.

Sleeve valve-outlet assembly 31 is comprised of a tubular collar 35 having one or more radially-extending slurry outlet ports 36 through the wall thereof. Slidably mounted within an internal recess 37 on collar 35 is valve sleeve 38 which, in turn, has a radially-extending passage 39 therethrough which fluidly communicates with ports 36 when the valve is in an open position (FIG. 4A). Sliding sleeve valve 38 has appropriate O-ring seals 40 or the like thereon to form a seal between the outer surface of valve 39 and the inner surface of collar 35. Annular seals **41*a*, 41*b* are fixed to and carried by valve 38 and are positioned on either side of passage 39 to effectively form an annular channel in fluid communication with passage 39**.

Slidably mounted within recess 37 below sleeve valve 38 is detent ring 42 which, in turn, carries an inner and outer, spring-biased detent 43, 44, respectively, for a purpose to be described below. While being disclosed as a separate element, it should be understood that detent ring 42 could be made integral with sliding valve 38 without effecting the function of either element.

A specially constructed washpipe 50 is positioned within workstring 14 and extends from the surface through all of the screen units 30. As best seen in FIGS. 2 and 3, the lower end of washpipe 50 (i.e. that portion which extends through the screen units) is comprised of two concentric tubulars members 51, 52 which, in turn, form a longitudinally-extending passage 53 therebetween. The upper end of the centermost or inner tubular member 51 is closed at 54 to divert upward flow through one or more cross-over ports 55 (only one shown in FIG. 3) which are in fluid communication with the annulus 56 formed between washpipe 50 and pipe 57.

Small cross tubes 58 (FIGS. 2 and 4A) fluidly communicate the outside of outer tubular member 52 with the interior of inner tubular member 51 of the double-walled washpipe 50 to form leak-off or cross-through ports for a purpose described below. One or more radially-extending ports 60 (FIGS. 4A, 4B) are provided through outer tubular member 52 at spaced lengths along member 52 so that each port or set of radial ports will be aligned to fluidly communicate passage 53 with the annular channel formed between seals 41*a* and 41*b* on sliding valve 38.

In operation, apparatus 20 is lowered into wellbore 11 on workstring 14 and is positioned adjacent formation 12. Packer 22 is set as will be understood by those skilled in the art. Gravel slurry is then pumped down washpipe 50 with most of the slurry originally exiting through passage 39 in sleeve valve 38 (FIG. 3) and out outlet ports 65 in cross-over extension 23. Sleeve valve 38 in the cross-over extension is basically identical in both construction and function as the other valves 38 described above in relation to sliding valve-outlet assemblies 30.

As the gravel slurry flows downward in annulus 13 around the screen units, it is likely to lose liquid to formation 12 and/or through screen 32. The liquid entering screen 32 is returned to the surface through cross tubes 58 (FIG. 4A), inner conduit 51, cross-over ports 55, and annulus 56 (FIG. 3). The gravel carried by the slurry is deposited and collects in the annulus to form the gravel pack. As is known in the art (see U.S. Pat. No. 4,945,991), if enough liquid is lost from the slurry before the annulus is filled, a sand bridge (not shown) is likely to form which will block flow through annulus 13 and prevent further filling below the bridge. If this occurs while using the present invention, the gravel slurry can continue to flow downward through passage 53 and out respective ports 60 in outer conduit 52 and outlets 36 in the respective collars 35.

When gravel pack apparatus 20 is run into the wellbore, all of the valves 38 are held in an open position (FIG. 4A) by gravity or by a shear pin or the like (not shown). When in an open position, the radial passage 39 in a respective sleeve valve 38 is aligned with outlet ports 36, 65 in collars 35 or cross-over extension 23 as the case may be. Passage 39 in valve 38 communicates with the annular channel formed between annular seals 41*a*, 41*b* on sleeve valve 38 which, in turn, communicates with ports 60 in outer conduit 52. Accordingly, slurry flowing down passage 53 between inner and outer conduits 51, 52 will flow through ports 60, 39, and 36 and into annulus 13 at the respective location of each sliding valve-outlet assembly 31 to complete the gravel pack. Any fluid leaking back through a screen 32 will flow through cross tubes 58 (FIG. 4A) into inner tube 51 to be return via cross-over extension 23 to the surface.

Figure 4B:
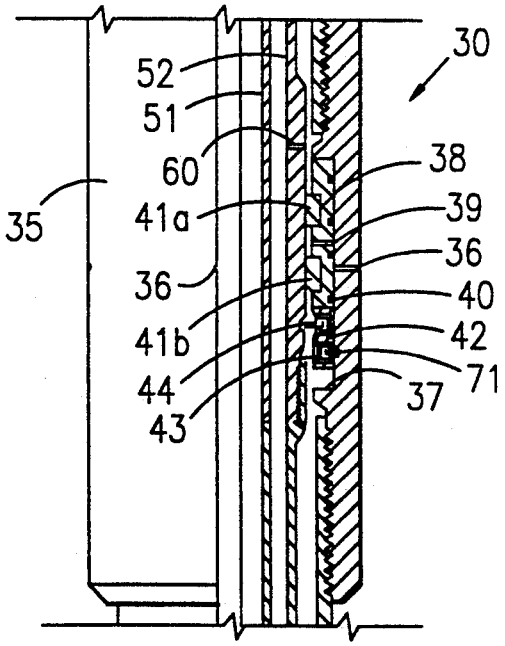
FIG. 4B is an elevational view of the sliding valve-outlet assembly of FIG. 4A with the valve in a closed position.

When annulus 13 has been gravel packed, flow of slurry is stopped and washpipe 50 is removed to the surface. Outwardly-biased detent 44 on ring 42 will engage shoulder 70 (FIG. 4A and 4B) as washpipe 50 moves upward and will cause detent ring 42 to be carried upward thereby moving sliding sleeve valve 38 to a closed position (FIG. 4B). As valve 38 reaches its closed position, inner detent 43 will be biased outward into recess 71 to secure a respective valve in its closed position. Continued upward movement of washpipe 50 will shear the outer detents 44 whereby washpipe 50 can be removed to the surface.

The distribution of gravel directly to the various levels in the annulus from an internal passage in the gravel pack apparatus is believed to provide a better distribution of gravel throughout a completion interval which results in a better overall gravel pack efficiency, especially where long wellbore intervals are being completed. At the same time, the passages used for delivering the gravel, being inside the gravel pack apparatus, are protected from damage and abuse during handling and installation of the gravel pack screen.

What is claimed is:

1. A method of gravel packing an interval of a wellbore, said method comprising:

positioning a gravel pack apparatus within said wellbore adjacent said interval whereby an annulus is formed between said apparatus and said wellbore;

flowing a gravel slurry from the surface and through the interior of said gravel pack apparatus;

distributing said gravel slurry from the interior of said apparatus at different points within said annulus through a plurality of spaced outlets along said apparatus; and closing said outlets after said slurry is distributed.

2. The method of claim I wherein said gravel slurry is flowed to said spaced outlets through a washpipe which extends through said apparatus.

3. The method of claim 2 wherein said outlets are closed when said washpipe is removed from said apparatus.

4. Apparatus for gravel packing an interval of a wellbore, said apparatus comprising:

a plurality of gravel screen units connected together, each of said screen units comprising:

a gravel screen; and a valve-outlet assembly connected to said screen, said assembly having at least one outlet and a valve which allows flow through said outlet when in an open position and blocks flow through said outlet when in a closed position; and means for delivering gravel slurry through the interior of said gravel screen units to each of said at least one outlet in each said valve-outlet assembly; and means for closing each said valve.

5. The apparatus of claim 4 wherein said means for delivering said gravel slurry comprises:

a washpipe extending substantially through all of said gravel screen units and having a respective outlet in fluid communication with each said outlet in each said valve-outlet assembly.

6. The apparatus of claim 5 wherein said means for closing each said valve comprises:

means on each of said valves adapted to engage said washpipe whereby said respective valves will be moved to a closed position as said washpipe is removed from said gravel screen units.

7. The apparatus of claim 6 including:

means for securing each of said valves in said closed position.

8. The apparatus of claim 7 including:

a cross-over connected to the upper end of said gravel screen units, said cross-over having at least one outlet in fluid communication with an outlet in said washpipe.

9. The apparatus of claim 8 including:

a valve for closing said at least one outlet in said cross-over when said washpipe is removed.

10. The apparatus of claim 9 wherein said washpipe comprises:

an outer conduit;

an inner conduit concentrically positioned within said outer conduit and spaced therefrom to form an passage therebetween which extends substantially through said gravel screen units.

11. The apparatus of claim 9 wherein each valve-outlet assembly comprises:

a collar having a radial outlet therein and an annular recess on the inner surface thereof;

and wherein said valve comprises:

a sleeve value slidably positioned within said recess and movable between an open position and a closed position, said sleeve valve having a radial opening therethrough which fluidly communicates with said outlet when said valve is in said open position.

* * * * *